US007688271B2

(12) United States Patent
Cao et al.

(10) Patent No.: US 7,688,271 B2
(45) Date of Patent: Mar. 30, 2010

(54) DIPOLE ANTENNA

(75) Inventors: Huy T. Cao, Dallas, TX (US); Kevin Eldon Linehan, Rowlett, TX (US); Martin L. Zimmerman, Chicago, IL (US); Xiangyang Ai, Richardson, TX (US)

(73) Assignee: Andrew LLC, Westchester, IL (US)

( * ) Notice: Subject to any disclaimer, the term of this patent is extended or adjusted under 35 U.S.C. 154(b) by 888 days.

(21) Appl. No.: 11/405,814

(22) Filed: Apr. 18, 2006

(65) Prior Publication Data

US 2007/0241983 A1 Oct. 18, 2007

(51) Int. Cl.
*H01Q 21/26* (2006.01)

(52) U.S. Cl. ..... 343/797; 343/799; 343/806; 343/810

(58) Field of Classification Search ..... 343/797
See application file for complete search history.

(56) References Cited

U.S. PATENT DOCUMENTS 6,313,809 B1 11/2001 Gabriel et al.
6,608,600 B2 * 8/2003 Eriksson ..... 343/797
6,819,300 B2 11/2004 Gottl
6,940,465 B2 9/2005 Gottl et al.
7,173,572 B2 * 2/2007 Teillet et al. ..... 343/810
2004/0263392 A1 12/2004 Bisiules et al.
2006/0232490 A1 * 10/2006 Bisiules et al. ..... 343/797
2007/0229385 A1 * 10/2007 Deng et al. ..... 343/797
2007/0252778 A1 * 11/2007 Ide et al. ..... 343/907

FOREIGN PATENT DOCUMENTS

WO 03/083992 10/2003
WO 2004/055938 7/2004

* cited by examiner

*Primary Examiner*—Trinh V Dinh
(74) *Attorney, Agent, or Firm*—Husch Blackwell Sanders Welsh & Katz

(57) ABSTRACT

A dipole antenna comprising a base; first and second pairs of dipoles positioned in front of the base and arranged around a central region; a first feed line which extends from the base towards the dipoles and splits at a first junction positioned in front of the base into a first pair of feed probes each of which is coupled to a respective one of the first pair of dipoles; and a second feed line which extends from the base towards the dipoles and splits at a second junction positioned in front of the base into a second pair of feed probes each of which is coupled to a respective one of the second pair of dipoles. The feed probes are spaced from the dipoles so as to field-couple with the dipoles. In one embodiment, the first pair of feed probes is positioned on a first side of the dipoles and the second pair of feed probes is positioned on a second side of the dipoles opposite to the first side. In another embodiment, the dipoles are printed on a PCB.

11 Claims, 13 Drawing Sheets

DIPOLE ANTENNA

FIELD OF THE INVENTION

The present invention relates to a dipole antenna comprising two pairs of dipoles arranged around a central region. An antenna of this kind is conventionally known as a "dipole square" or "dipole box", although the dipole arms may be formed to present a non-square (for example, circular) shape.

BACKGROUND OF THE INVENTION

FIG. 1 of U.S. Pat. No. 6,313,809 shows a dipole square with four connecting lines radiating from a centre point. U.S. Pat. No. 6,819,300 shows a dipole square where each dipole is driven be a respective coaxial cable. Various dipole square arrangements are also described in WO 2004/055938.

SUMMARY OF EXEMPLARY EMBODIMENTS

The exemplary embodiments of the invention provide a dipole antenna comprising a base; first and second pairs of dipoles positioned in front of the base and arranged around a central region; a first feed line which extends from the base towards the dipoles and splits at a first junction positioned in front of the base into a first pair of feed probes each of which is coupled to a respective one of the first pair of dipoles; and a second feed line which extends from the base towards the dipoles and splits at a second junction positioned in front of the base into a second pair of feed probes each of which is coupled to a respective one of the second pair of dipoles.

The exemplary embodiments of the invention also provide a dipole antenna comprising two pairs of dipoles arranged around a central region; and two pairs of feed probes each coupled to a respective dipole, wherein the feed probes are spaced from the dipoles so as to field-couple with the dipoles.

Certain exemplary embodiments of the invention also provide a dipole antenna comprising two pairs of dipoles arranged around a central region; a first pair of feed probes coupled to a first one of the pairs of dipoles; and a second pair of feed probes coupled to a second one of the pairs of dipoles, wherein the first pair of feed probes is positioned on a first side of the dipoles and the second pair of feed probes is positioned on a second side of the dipoles opposite to the first side.

BRIEF DESCRIPTION OF THE DRAWINGS

The accompanying drawings which are incorporated in and constitute part of the specification, illustrate embodiments of the invention and, together with the general description of the invention given above, and the detailed description of the embodiments given below, serve to explain the principles of the invention.

DETAILED DESCRIPTION OF EMBODIMENTS

Figure 1:
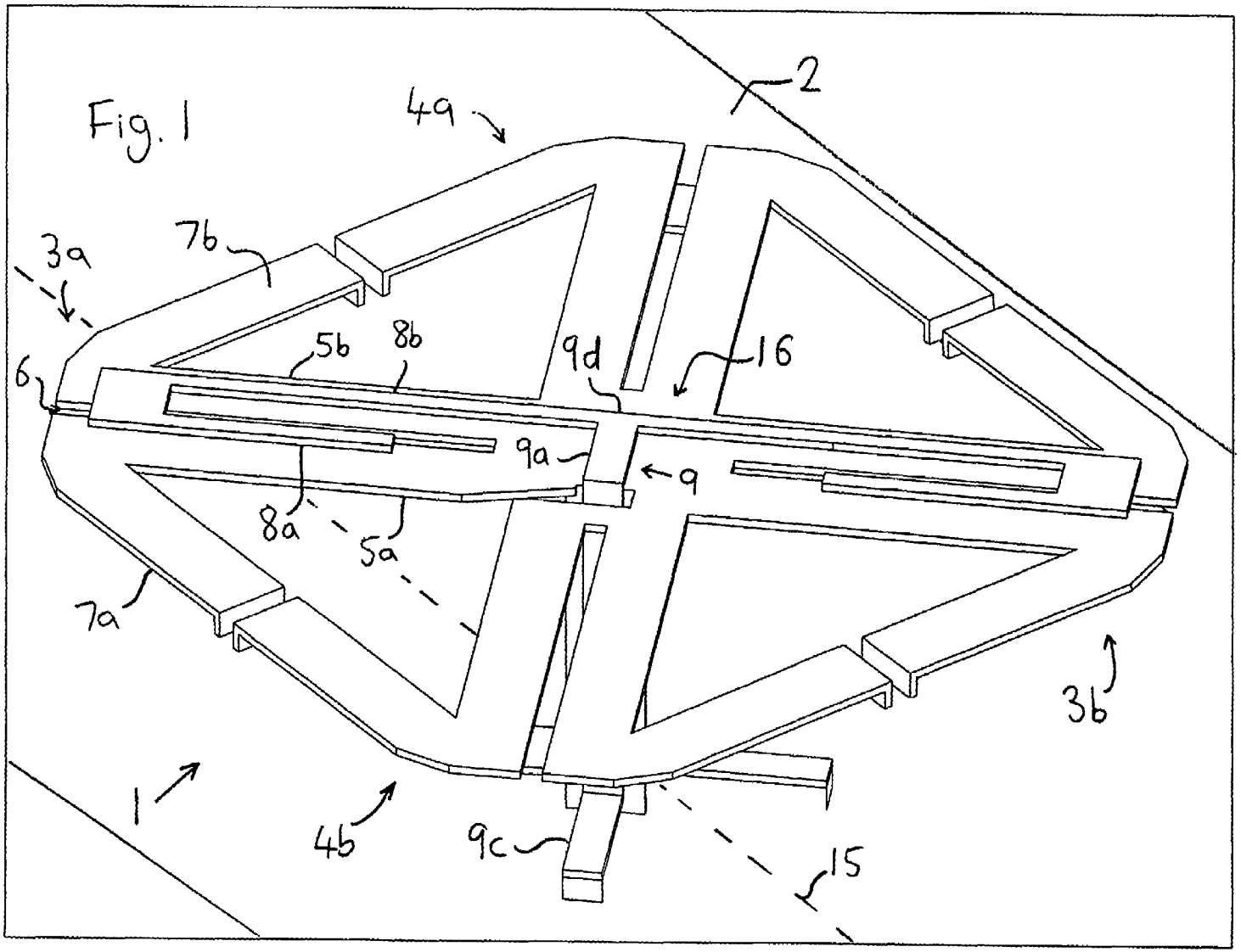
FIG. 1 is an isometric view of the front side of a dipole square according to a first embodiment of the invention.

Referring to FIG. 1, a dual-polarized dipole square 1 is shown mounted in front of a planar base 2 which provides support for the dipole square, as well as providing an electrical ground plane and back reflector for the antenna. The base 2 also carries a feed network (not shown). The dipole square comprises two pairs of dipoles diecast from a single piece of conductive material. A first pair of dipoles 3*a*, 3*b* is oriented at an angle of −45° to the axis 15 of the antenna, and a second pair of dipoles 4*a*, 4*b* is oriented at an angle of +45° to the axis of the antenna. The two pairs of dipoles are non-intersecting, and are arranged around a central region 16 (in contrast to a crossed-dipole antenna in which a single pair of dipoles intersects at the centre of the antenna).

The antenna comprises a line of dipole squares of the kind shown in FIG. 1, arranged in a line along the antenna axis 15, which is generally aligned vertically (or slightly tilted down). The other dipole squares are not shown.

The dipoles are identical in construction and only the dipole 3*a* will be described for illustration. The dipole 3*a* comprises a pair of legs 5*a*, 5*b* which extend radially from the central region 16 and parallel with the base and are separated by a slot 6, and a pair of dipole arms 7*a*, 7*b* oriented parallel to and perpendicular with the antenna axis 15.

The dipole 3*a* is driven by a hook-shaped balun feed probe having a portion 8*b* running parallel and proximate to the front face of the leg 5*b*, and a portion 8*a* running parallel and proximate to the front face of the leg 5*a*. The balun is mounted to the legs 5*a*,5*b* by insulating spacers (not shown). The portion 8*a* of the balun is connected to a feed line 9 at the centre of the dipole square.

Figure 2:
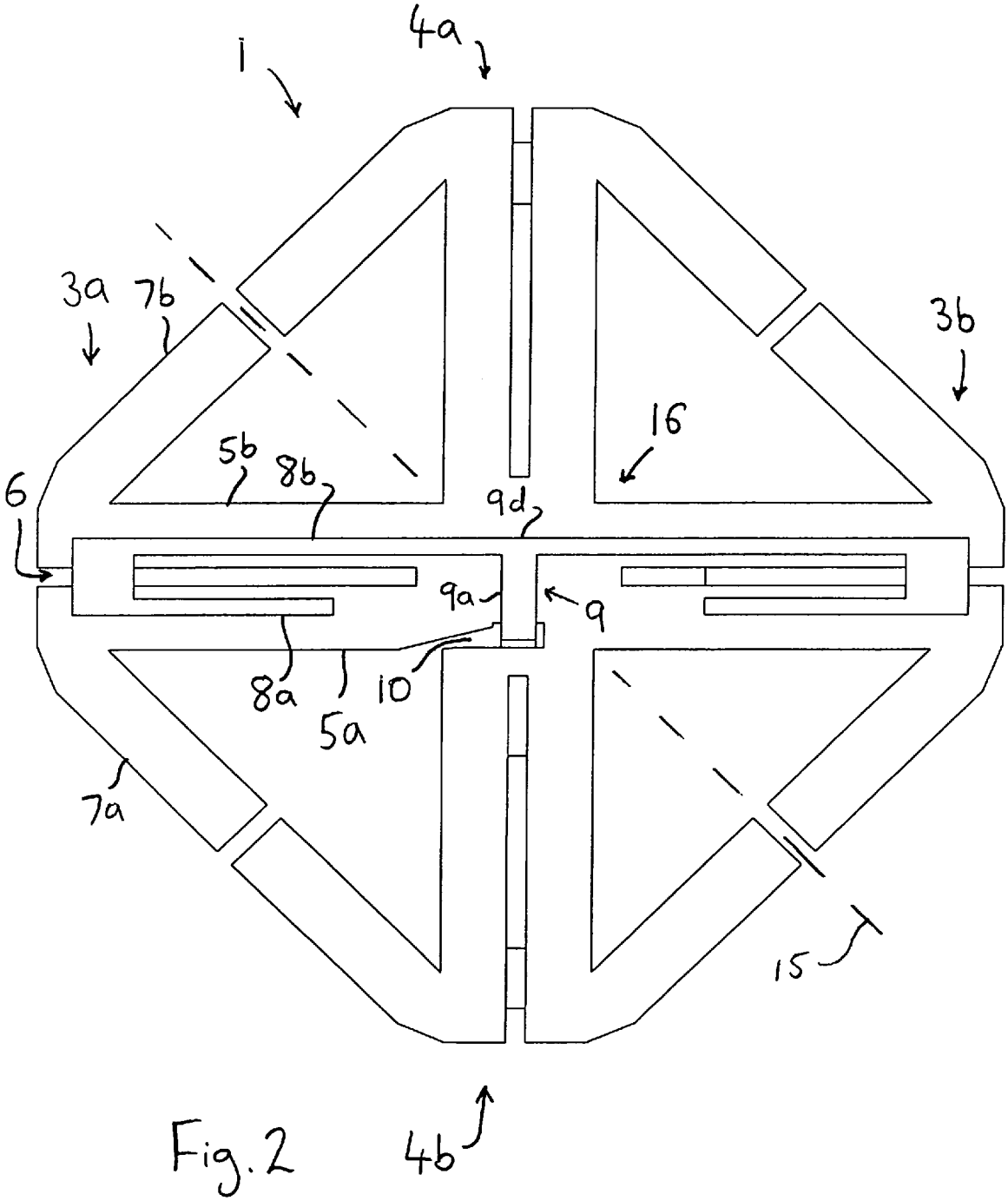
FIG. 2 is a plan view of the front side of the dipole square.
Figure 4:
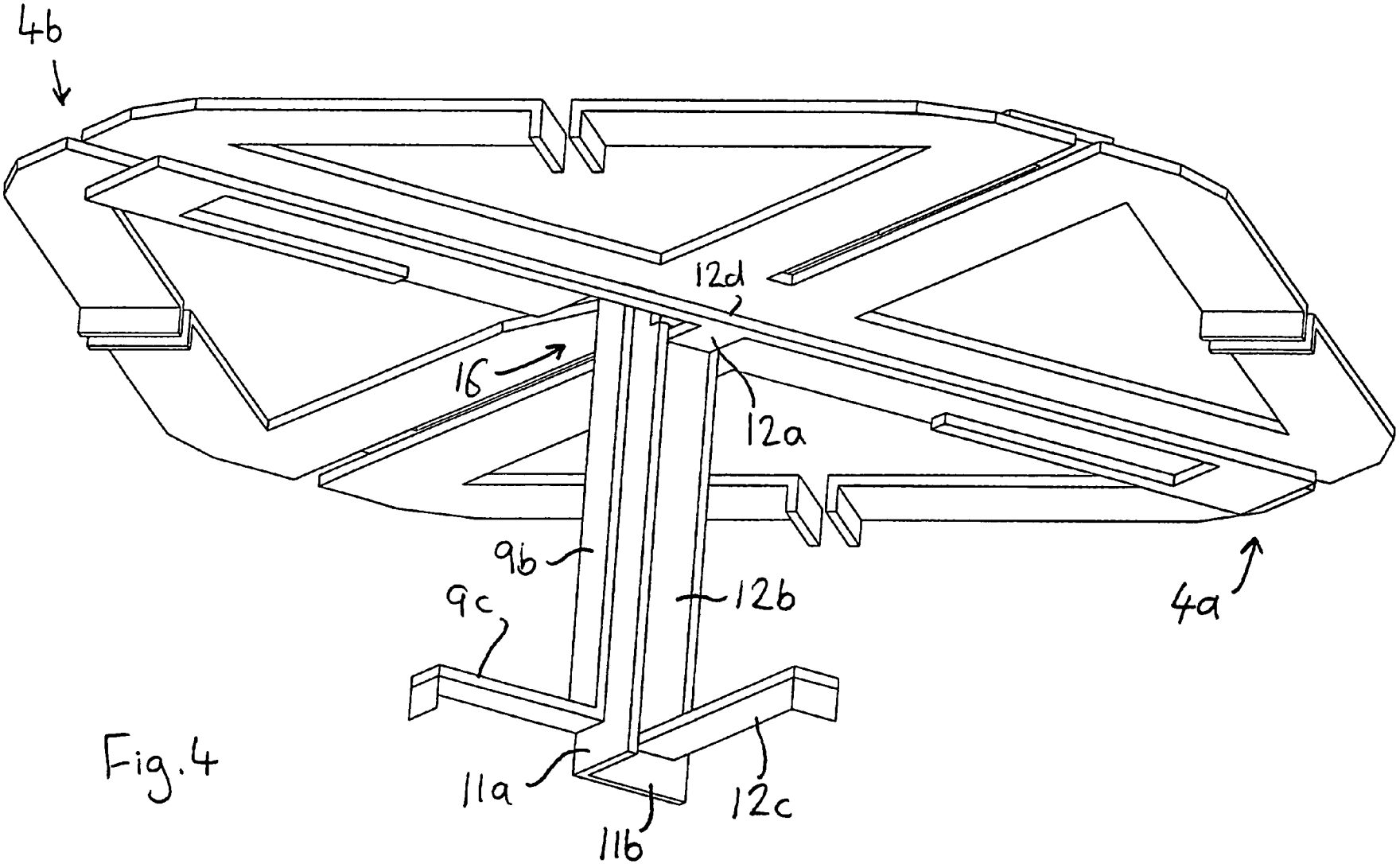
FIG. 4 is a isometric view of the dipole square taken from the rear.
Figure 5:
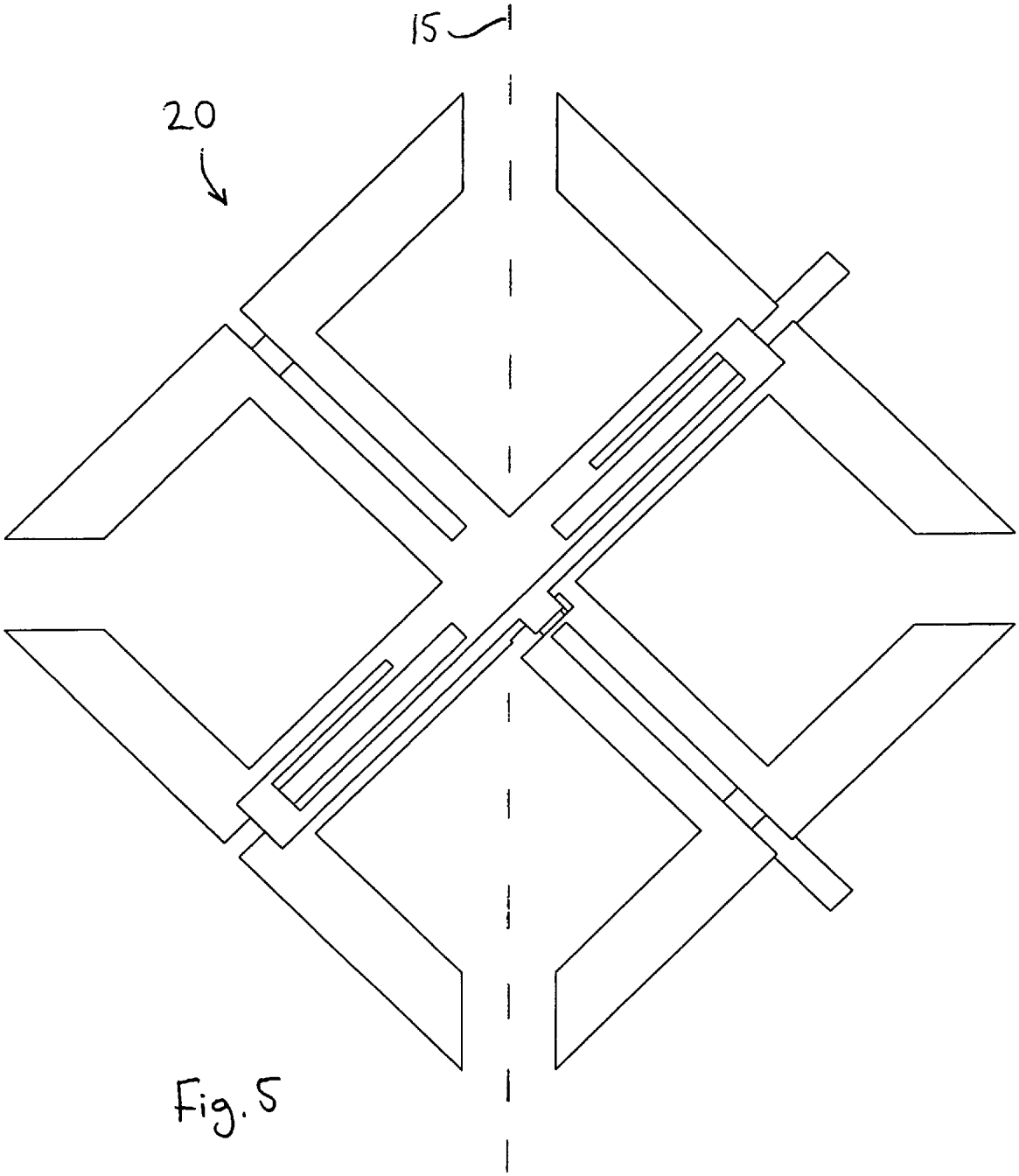
FIG. 5 is a plan view of the front side of a diamond-shaped dipole square according to a second embodiment of the invention.

The feed line has a front portion 9*a* shown in FIGS. 1 and 2, a portion 9*b* shown in FIG. 4 which extends from the base towards the dipoles, and a rear portion 9*c* also shown in FIG. 4 which has a tab at it end which slots into the base 2. A slot 10 is formed at the junction between the dipoles 3*a*,4*b*.

A V-shaped leg shown in FIG. 4 extends from the central region 16 of the dipole square. The V-shaped leg provides a support structure to support the dipoles and the feed lines in front of the base 2. The support leg has a first part 11*a* extending from the edge of the slot 10 and oriented at an angle −45° to the axis 15 of the antenna, and a second part 11*b* oriented at an angle of +45° to the axis of the antenna and connected to the rear side of the central region of the dipoles as shown most clearly in FIG. 3.

The portion 9*b* of the feed line is mounted to the first part 11*a* of the support leg by a pair of insulating spacers (not shown). The feed line 9 then passes through the slot 10 as shown most clearly in FIG. 1.

The dipole 3*b* is driven by a second hook-shaped balun which is connected to the portion 9*a* of the feedline at a two-way junction 9*d* in front of the dipoles.

Figure 3:
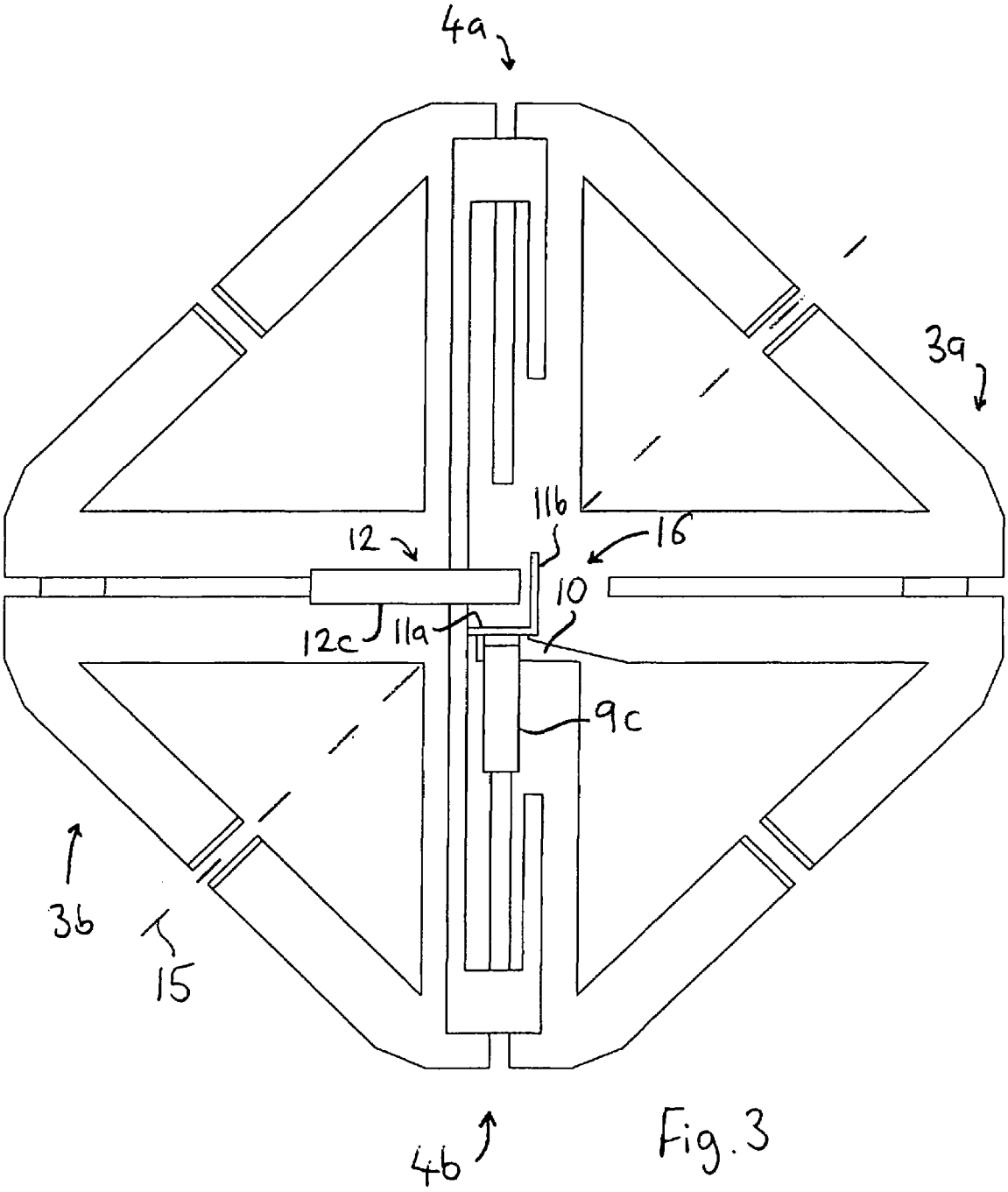
FIG. 3 is a plan view of the rear side of the dipole square.

The dipoles 4*a*,4*b* are driven by a similar balun arrangement, but in this case the baluns are positioned on the opposite rear side of the antenna as shown most clearly in FIGS. 3 and 4. Dipole 4*a* is driven by a hook-shaped balun feed probe having a portion running parallel and proximate to the rear face of one leg of the dipole, and a portion running parallel and proximate to the rear face of the other leg. The balun is mounted to the legs by insulating spacers (not shown) and connected to a feed line 12 approximately at the centre of the dipole square.

The feed line 12 is similar to the feed line 9, and has a front portion 12*a*, a portion 12*b* extending from the base, and a rear portion 12*c* which has a tab at it end which slots into the base 2.

The portion 12*b* of the feed line is mounted to the second part 11*b* of the support leg by insulating spacers (not shown).

The dipole 4*b* is driven be a second hook-shaped balun which is connected to the portion 12*a* of the feedline at a two-way junction 12*d* positioned between the base and the dipoles.

The two pairs of dipoles are proximity fed by the baluns to radiate electrically in two polarization planes simultaneously. The dipole square is configured to operate at a frequency range of 806 Mhz-960 MHz, although the same arrangement can be used to operate in other frequency ranges.

Splitting the feed lines at junctions 9*d*,12*d* positioned in front of the base means that only two feed lines (instead of four) are required to couple the dipoles to the feed network (not shown) carried by the base 2. As a result, only two feed lines are required on the base feed network (instead of four). This means that the feed network on the base can be fitted to a conventional crossed-dipole antenna (which only requires two feed lines) as well as the dipole square shown in FIG. 1.

The proximity-fed airstrip arrangement (in which the baluns are spaced from the dipoles by an air gap so that they field-couple with the dipoles) results in higher bandwidth compared with a conventional direct-fed antenna (in which the dipoles are physically connected to the feed probe by a solder joint). Also the lack of solder joints resulting from the proximity-fed arrangement results in less risk of intermodulation and lower manufacturing costs compared with a conventional direct-fed antenna.

Placing the baluns on opposite sides of the dipoles also improves isolation between the two polarizations.

Figure 6:
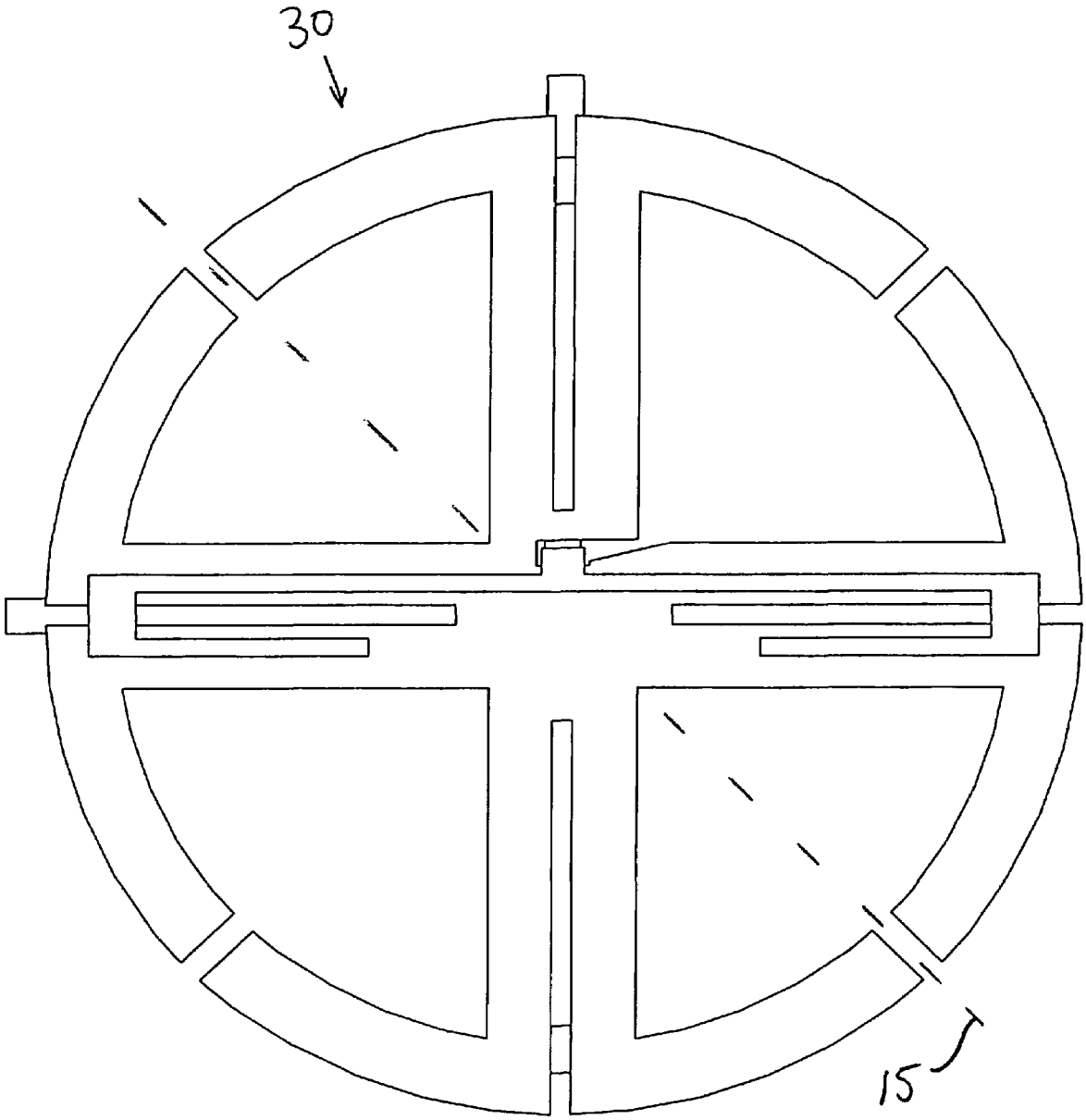
FIG. 6 is a plan view of the front side of a circular dipole square according to a third embodiment of the invention.

A second dipole square 20 is shown in FIG. 6. The dipole square 20 is identical to the dipole square 1 except that the arms of the dipoles are orientated at +/−45° to the antenna axis 15 instead of 0° and 90°. As a result the dipole square 20 presents a diamond-shaped profile in comparison with the square-shaped profile of the dipole square 1.

Figure 7:
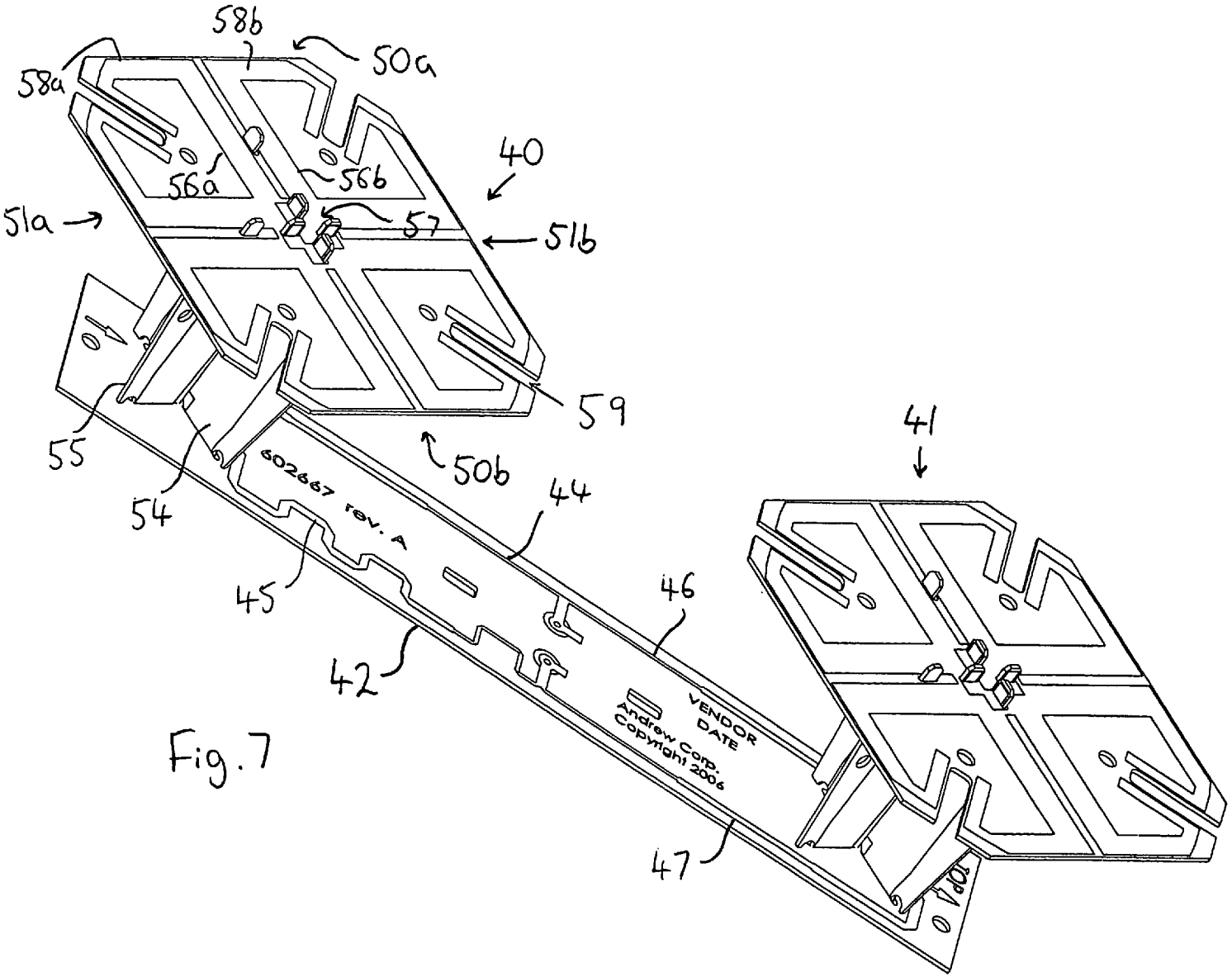
FIG. 7 is an isometric view of the front side of a PCB-based dipole square antenna according to a fourth embodiment of the invention.

A third dipole square 30 is shown in FIG. 7. The dipole square 30 is identical to the dipole squares 1,20 except that the arms of the dipoles are curved in the form of a circle centred at the centre of the dipole square. As a result the dipole square 30 presents a circular-shaped profile in comparison with the square and diamond-shaped profiles of the dipole squares 1,20.

The dipole squares described above are formed in a single piece by diecasting. The dipole squares in the embodiment described below are implemented instead on printed circuit boards (PCBs).

Figure 8:
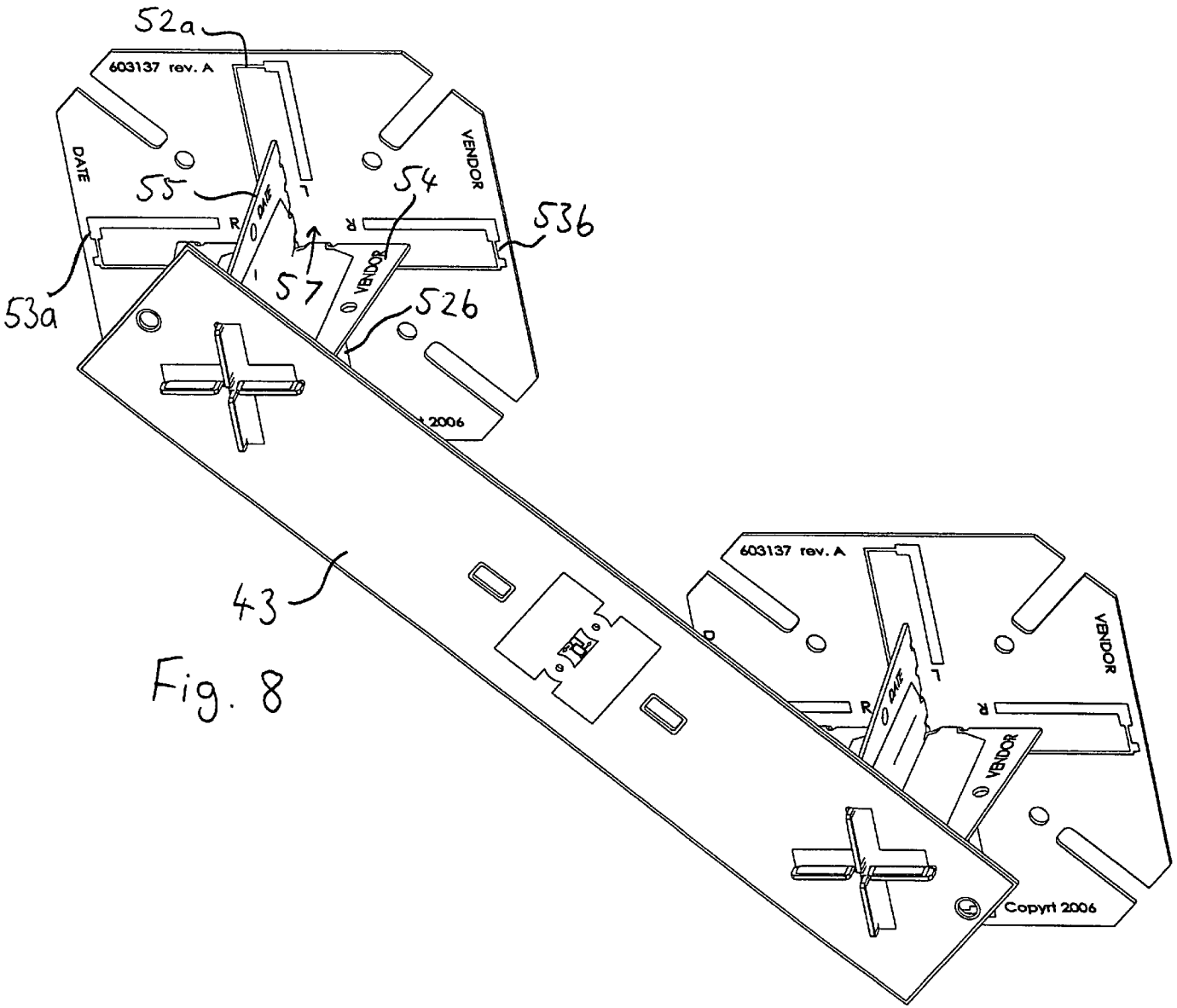
FIG. 8 is an isometric view of the rear side of the dipole square antenna of FIG. 7.

FIG. 7 is an isometric view of a pair of dipole squares 40,41 mounted on a base PCB 42. The base PCB 42 has a rear face carrying a layer of metal 43 (shown in FIG. 8) forming an electrical ground plane and acting as a reflector, and a network of feed lines 44-47 printed on its front face.

Figure 9:
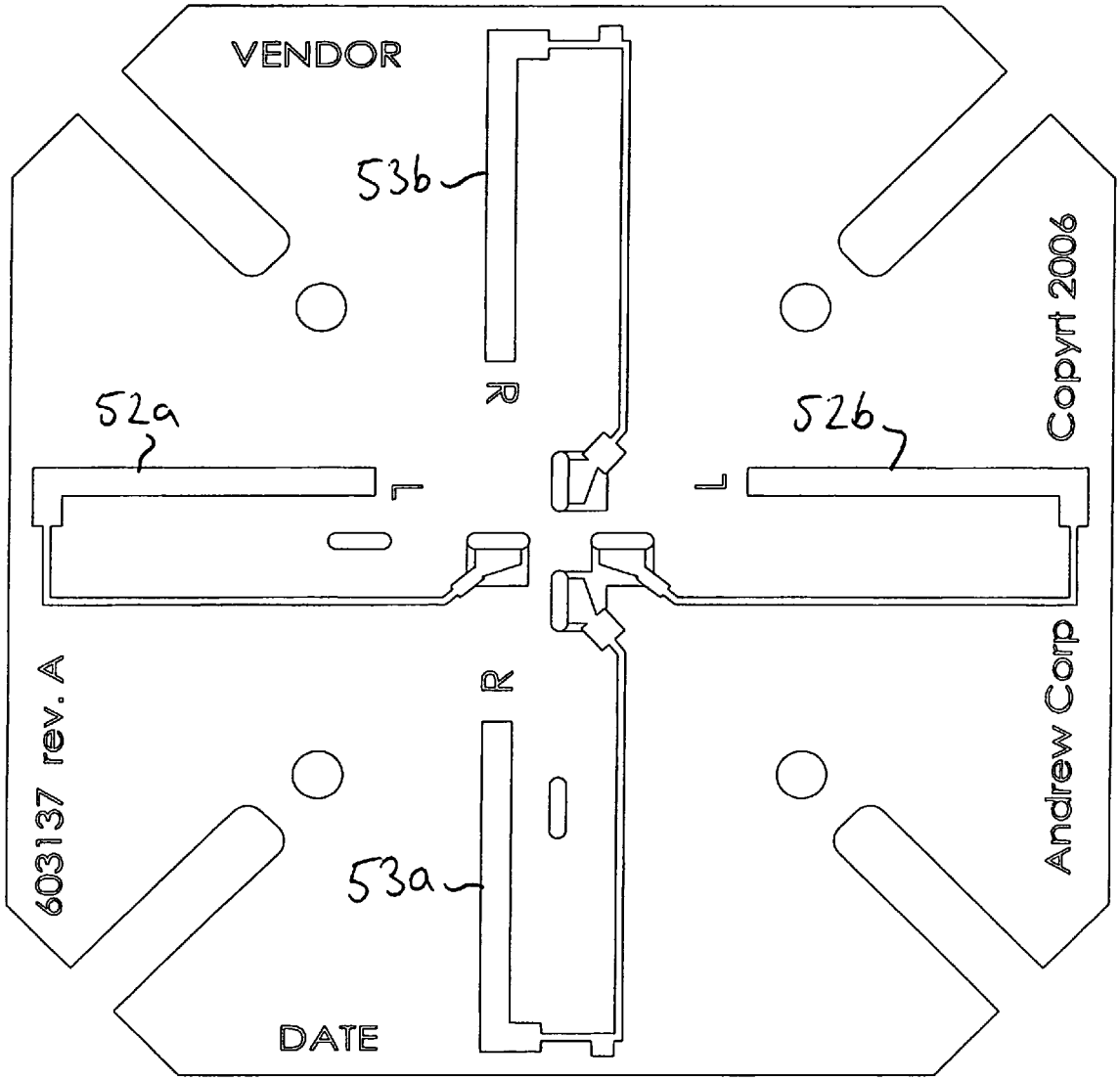
FIG. 9 is a plan view of the rear side of a dipole PCB used in one of the dipole squares shown in FIGS. 7 and 8.

The dipole squares are identical so only the dipole square 40 will be described. The dipole square 40 comprises a dipole PCB formed with dipoles 50*a*,50*b*,51*a*,51*b* on its front face shown in FIG. 7, and hook-shaped baluns 52*a*,52*b*,53*a*,53*b* on its rear face shown in FIGS. 8 and 9.

The dipoles are identical in construction and only the dipole 50*a* will be described for illustration. The dipole 50*a* comprises a pair of legs 56*a*, 56*b* which extend radially from a central region 57 and are separated by a gap. A pair of dipole arms 58*a*, 58*b* each have a proximal portion oriented at −45° to the antenna axis and a distal portion oriented respectively parallel to and perpendicular with the antenna axis. The dipoles are separated by slots 59 in the corners of the PCB. The dipole square presents a generally octagonal profile.

Figure 10:
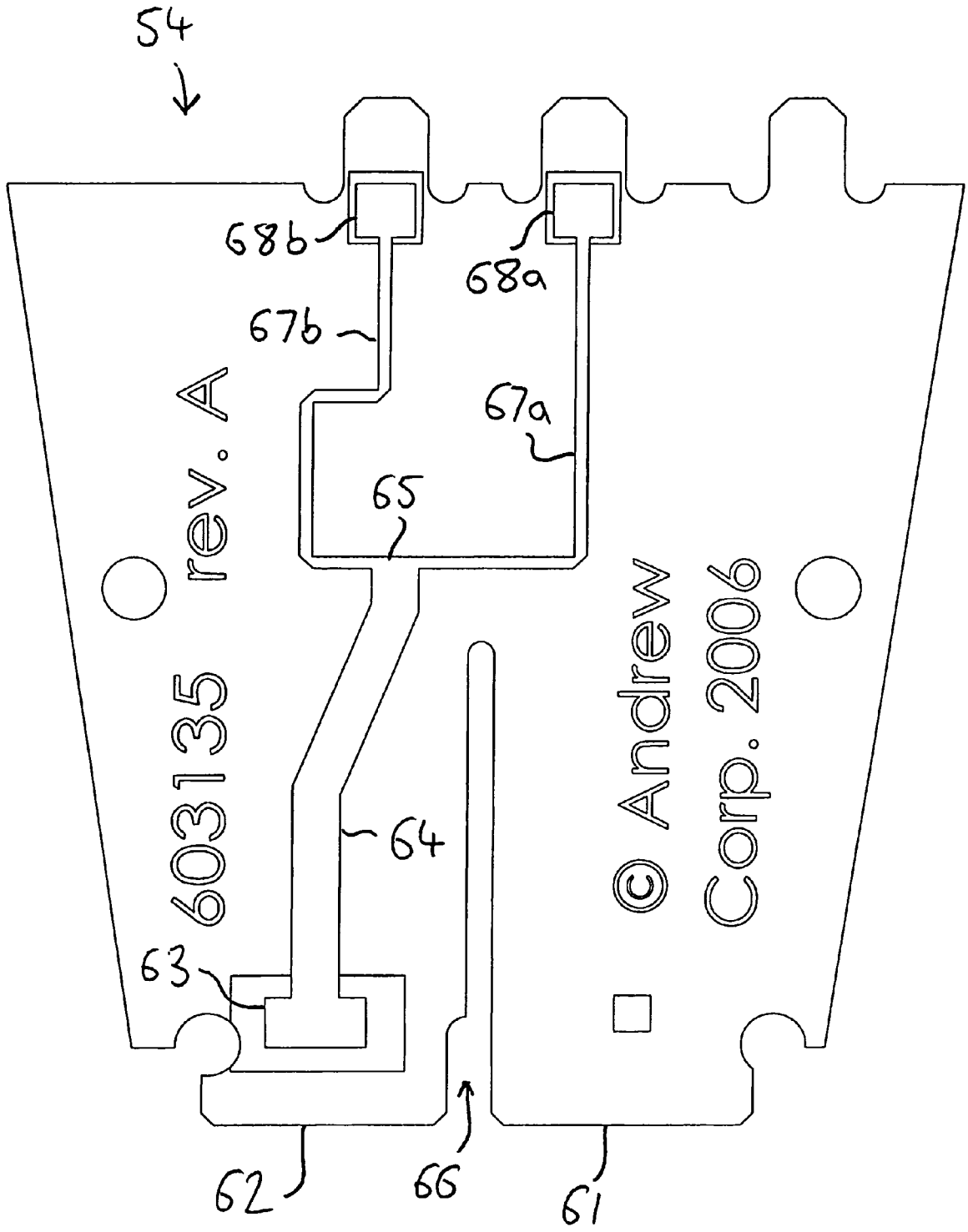
FIG. 10 is a first side view of a first feed PCB used in one of the dipole squares shown in FIGS. 7 and 8.
Figure 11:
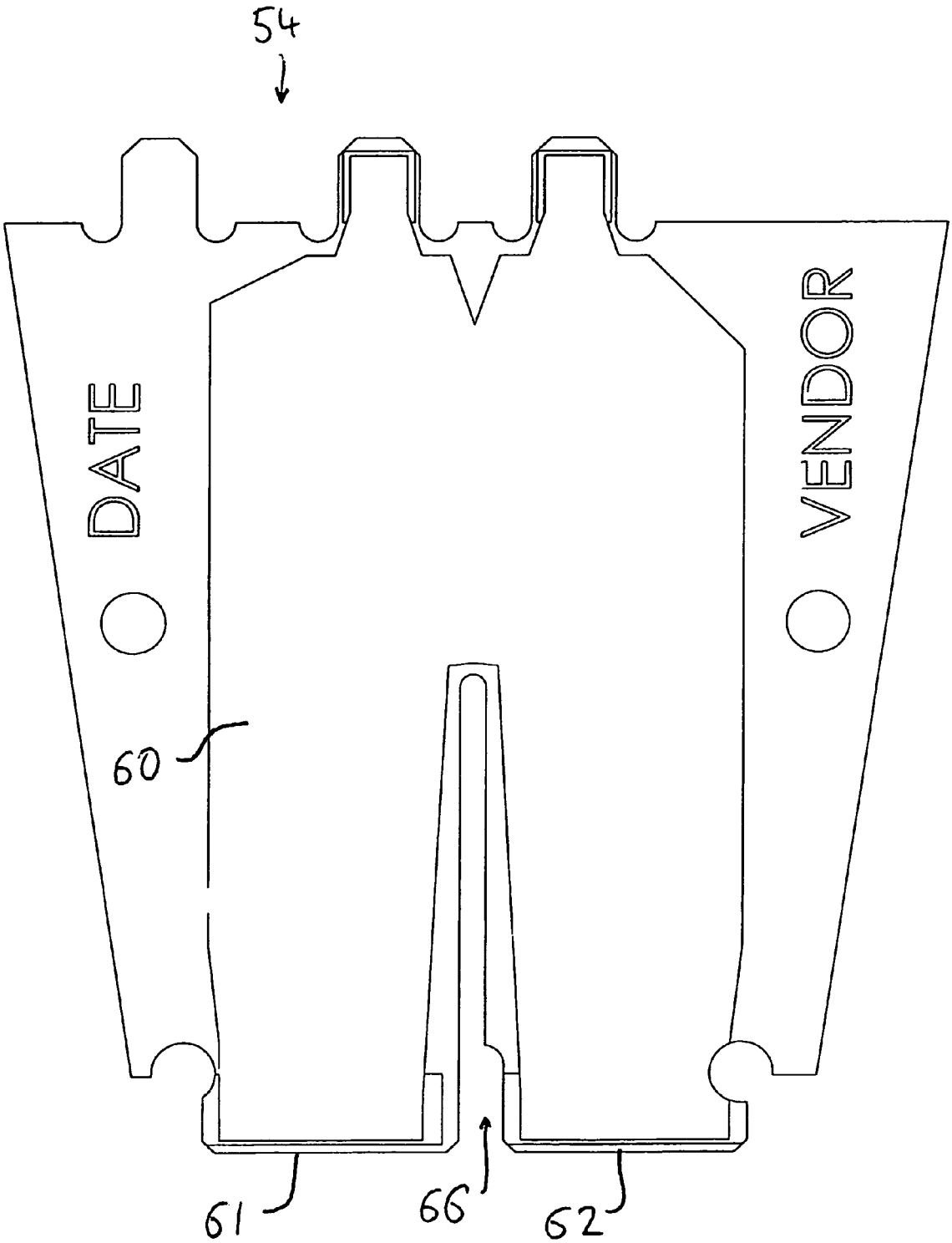
FIG. 11 is a second side view of the first feed PCB.

A support structure for the dipole PCB is provided by a crossed pair of feed PCBs 54,55 (shown in detail in FIGS. 10-13) which engage the underside of the central region 57 of the dipole PCB. The feed PCB 54 shown in FIGS. 10 and 11 is oriented at +45° to the antenna axis, and has a metal ground plane layer 60 on the face shown in FIG. 11, and a Y-shaped feed network on the face shown in FIG. 10. The feed PCB 54 also has a pair of tabs 61,62 which pass through slots in the base PCB 42. The ground plane layer 60 is soldered to the ground plane/reflector layer 43 on the rear face of the base PCB 42. The Y-shaped feed network shown in FIG. 10 has a pad 63 which is soldered to the feed line 45 on the front face of the base PCB 42.

A feed line 64 extends from the pad 64 away from the base PCB 42 towards the dipoles, and splits at a junction 65 positioned approximately midway between the base PCB 42 and the dipole PCB, and in front of a slot 66 in the feed PCB 54. The feed line 64 splits at the junction 65 into a first feed probe 67*a* with a pad 68*a*, and a second feed probe 67*b* with a pad 68*b*. The pad 68*a* is soldered to the balun 52*a* and the pad 68*b* is soldered to the balun 52*b*.

Figure 12:
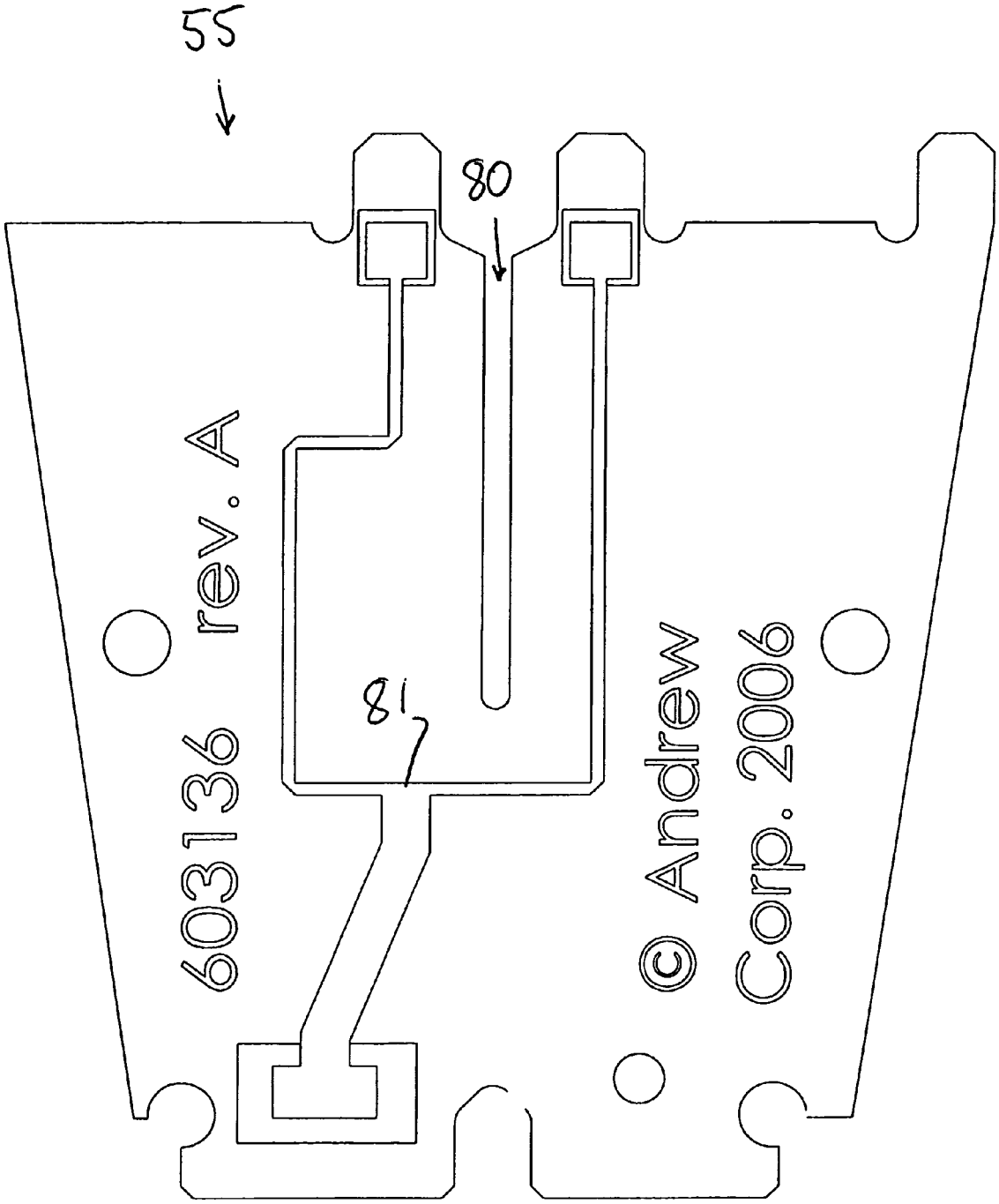
FIG. 12 is a first side view of a second feed PCB used in one of the dipole squares shown in FIGS. 7 and 8.
Figure 13:
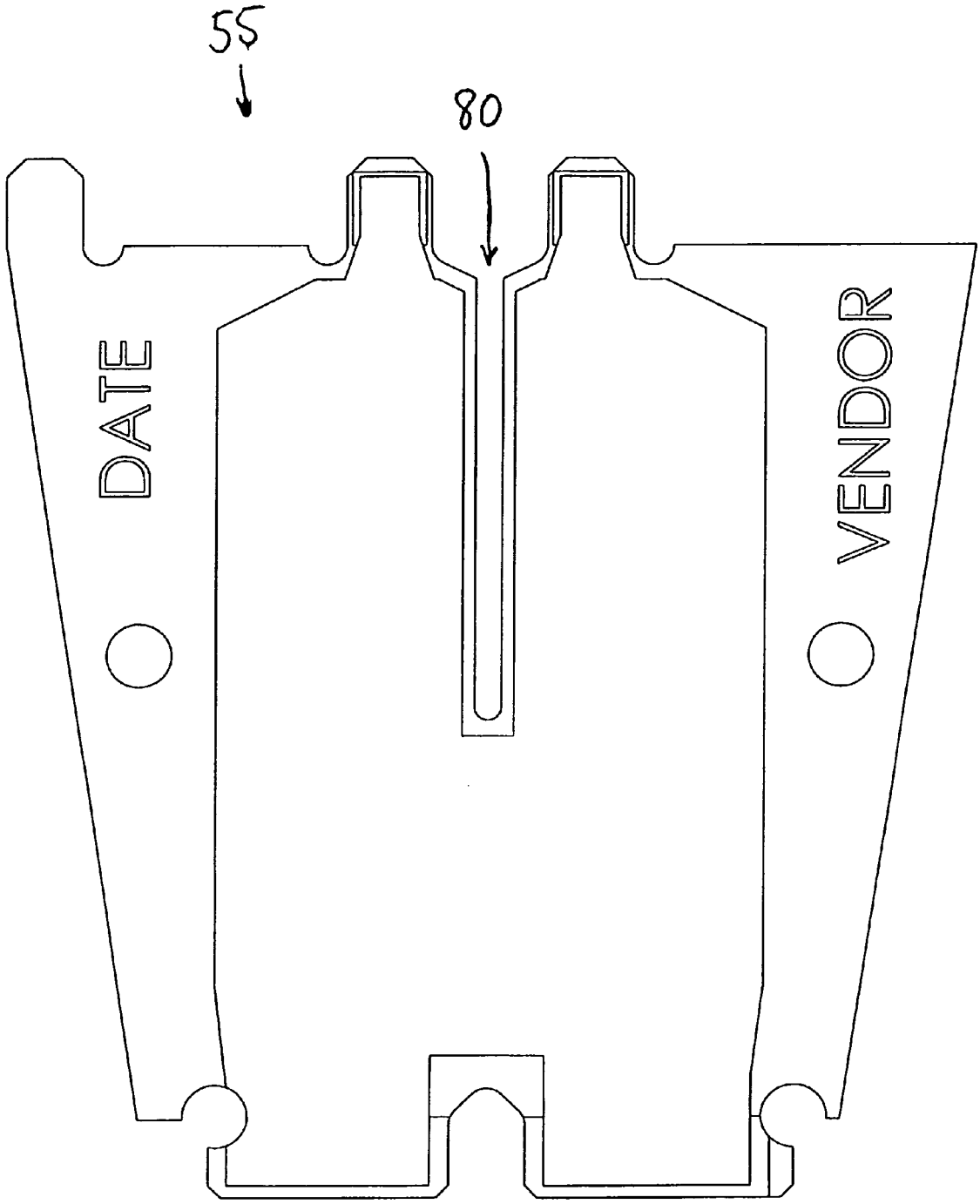
FIG. 13 is a second side view of the second feed PCB.

The feed PCB 55 shown in FIGS. 12 and 13 is similar in construction to the feed PCB 54, the only differences being that the slot 80 extends from the front edge instead of the rear edge of the PCB, and the junction 81 of the feed network is positioned to the rear of the slot 80. The feed PCBs 54,55 are fitted together in the crossed configuration shown in FIGS. 7 and 8 by means of the slots 66,80.

The dipoles are proximity fed by the baluns to radiate electrically in two polarization planes simultaneously. The dipole square is configured to operate at a frequency range of 1710 Mhz-2100 MHz, although the same arrangement can be used to operate in other frequency ranges.

Splitting the feed line 64 at a junction 65 positioned in front of the base PCB 42 means that only a single pad 63 is required to couple to the feed network on the base PCB 42. As a result, only two feed lines 44,45 are required on the base PCB 42 (instead of four). This means that the base PCB 42 can be fitted to a conventional crossed-dipole antenna (which only requires two feed lines) as well as the dipole square shown in FIGS. 7 and 8.

The proximity-fed arrangement (in which the baluns are spaced from the dipoles on the opposite side of the PCB so that they field-couple with the dipoles) results in higher bandwidth compared with a conventional direct-fed antenna (in which the dipoles are physically connected to the feed line by a solder joint). Also the lack of solder joints resulting from the proximity-fed arrangement results in less risk of intermodulation and lower manufacturing costs compared with a conventional direct-fed antenna.

Although the embodiments described above are all dual-polarized antennas, the invention may also be implemented in a circularly polarized antenna in which the four dipoles are driven 90° out of phase.

Although the embodiments described above can all operate in a transmit mode (in which the antenna transmits radiation) and a receive mode (in which the antenna receives radiation), the invention may also be implemented in an antenna which is configured to operate only in a transmit mode or only in a receive mode.

Additional advantages and modifications will readily appear to those skilled in the art. Therefore, the invention in its broader aspects is not limited to the specific details, representative apparatus and method, and illustrative examples shown and described. Accordingly, departures may be made from such details without departure from the spirit or scope of the Applicant's general inventive concept.

What is claimed is:

1. A dipole antenna comprising a base; first and second pairs of dipoles positioned in front of the base and arranged around a central region and disposed on a first surface of a printed circuit board; a first feed line which extends from the base towards the dipoles and splits at a first junction positioned in front of the base into a first pair of feed probes each of which is coupled to a respective one of the first pair of dipoles; and a second feed line which extends from the base towards the dipoles and splits at a second junction positioned in front of the base into a second pair of feed probes each of which is coupled to a respective one of the second pair of dipoles, the first and second pairs of feed probes being disposed on a second surface of the printed circuit board; a first support printed circuit board on which the first feed line and first junction is disposed; and a second support printed circuit board on which the second feed line and second junction is disposed, the first support printed circuit board and the second support printed circuit board extending from the base and supporting the printed circuit board.

2. The antenna of claim 1 wherein the first and second junctions are each positioned between the base and the dipoles.

3. The antenna of claim 1 wherein the feed probes are spaced from the dipoles so as to field-couple with the dipoles.

4. The antenna of claim 1 wherein each dipole has a pair of legs and a pair of arms, and wherein each feed probe has a first portion positioned next to a first leg of a dipole, and a second portion positioned next to a second leg of the dipole.

5. The antenna of claim 4 wherein the first and second portions have a hook-shaped profile.

6. The antenna of claim 1 wherein the feed probes are baluns.

7. The antenna of claim 1 further comprising a support structure which extends from the base and supports the dipoles and the feed lines.

8. A dipole antenna comprising a base, two pairs of dipoles arranged around a central region on a first surface of a printed circuit board first and second pairs of feed probes on a second surface of the printed circuit board, each coupled to a respective dipole, wherein the feed probes are spaced from the dipoles by the printed circuit board so as to field-couple with the dipoles; a first feed line which extends from the base towards the first pair of feed probes and splits at a first junction; a second feed line which extends from the base towards the second pair of the feed probes and splits at a second junction; a first support printed circuit board on which the first feed line and first junction is disposed; and a second support printed circuit board on which the second feed line and second junction is disposed, the first support printed circuit board and the second support printed circuit board extending from the base and supporting the printed circuit board.

9. The antenna of claim 8 wherein each dipole has a pair of legs and a pair of arms, and wherein each feed probe has a first portion positioned next to a first leg of a dipole, and a second portion positioned next to a second leg of the dipole.

10. The antenna of claim 9 wherein the first and second portions have a hook-shaped profile.

11. The antenna of claim 8 wherein the feed probes are baluns.

* * * * *